US006185895B1

(12) United States Patent
Rettew

(10) Patent No.: US 6,185,895 B1
(45) Date of Patent: Feb. 13, 2001

(54) VENTILATING RADIANT BARRIER

(76) Inventor: Robert A. Rettew, 93C Hilltop Manor, Clifton Park, NY (US) 12065

( * ) Notice: Under 35 U.S.C. 154(b), the term of this patent shall be extended for 0 days.

(21) Appl. No.: 09/220,951

(22) Filed: Dec. 24, 1998

(51) Int. Cl.[7] ..... E04D 1/08

(52) U.S. Cl. ..... 52/528; 52/528; 52/98; 52/108; 52/199; 52/309.8; 52/309.9; 52/406.2; 52/302.1; 428/55; 428/138

(58) Field of Search ..... 52/95, 98, 108, 52/199, 302.1, 281, 481.1, 518, 528, 555–559, 408, 309.8, 309.9, 406.2; 428/49, 50, 55–57, 124–126, 148, 138, 155

(56) References Cited

U.S. PATENT DOCUMENTS 2,860,768 * 11/1958 Smithers .
3,624,161 * 11/1971 Bub ..... 55/521
4,032,689 * 6/1977 Johnson et al. ..... 428/55
4,035,538 * 7/1977 Maekawa et al. ..... 428/155
4,852,314 * 8/1989 Moore, Jr. ..... 52/199
5,433,050 * 7/1995 Wilson et al. ..... 52/302.1
5,596,847 * 1/1997 Stephenson ..... 52/198
5,765,318 * 6/1998 Michelsen ..... 52/98

* cited by examiner

*Primary Examiner*—Carl D. Friedman
*Assistant Examiner*—Yvonne M. Horten

(57) ABSTRACT

A ventilating radiant barrier for reducing the solar or thermal load into a home through a rood while also providing ventilation beneath the exterior of the roof to protect the roof from moisture damage. The ventilating radiant barrier includes a panel has a pair of faces, a pair of end edges and a pair of side edges extending between the end edges of the panel. A first of the faces of the panel has a spaced apart pair of perforations rows extending between the end edges of the panel. The second face of the panel has a spaced apart pair of perforations rows extending between the end edges of the panel. The perforation rows of the second face of the panel are positioned between the perforation rows of the first face of the panel.

9 Claims, 3 Drawing Sheets

2
2
33
32
11
31
34
30

3
3
28
10
34
36
35

33
32
27
10
11
12
28
30
34
35
36
31

10
17
18
11
15
23
25
21
12
20
16
24
26
22
29

10
18
11
14
19
17
15
16
23
25
13
26
24

VENTILATING RADIANT BARRIER

BACKGROUND OF THE INVENTION

1. Field of the Invention

The present invention relates to insulating and ventilating systems and more particularly pertains to a new ventilating radiant barrier for reducing the solar or thermal load into a home through a roof while also providing ventilation beneath the exterior of the roof to protect the roof from moisture damage.

2. Description of the Prior Art

The use of insulating and ventilating systems is known in the prior art. More specifically, insulating and ventilating systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 5,303,525 by Magee; U.S. Pat. No. 5,433,050 by Wilson et al.; U.S. Pat. No. 4,852,314 by Moore, Jr.; U.S. Pat. No. Des. 372,545 by Schultz; U.S. Pat. No. 3,210,896 by Detman; and U.S. Pat. No. 3,498,015 by Seaburg et al.

While these devices fulfill their respective, particular objectives and requirements, the aforementioned patents do not disclose a new ventilating radiant barrier. The inventive device includes a panel that has a pair of faces, a pair of end edges and a pair of side edges extending between the end edges of the panel. A first of the faces of the panel has a spaced apart pair of perforation rows extending between the end edges of the panel. The second face of the panel has a spaced apart pair of perforation rows extending between the end edges of the panel. The perforation rows of the second face of the panel are positioned between the perforation rows of the first face of the panel.

In these respects, the ventilating radiant barrier according to the present invention substantially departs from the conventional concepts and designs of the prior art, and in so doing provides an apparatus primarily developed for the purpose of reducing the solar or thermal load into a home through a roof while also providing ventilation beneath the exterior of the roof to protect the roof from moisture damage.

SUMMARY OF THE INVENTION

In view of the foregoing disadvantages inherent in the known types of insulating and ventilating systems now present in the prior art, the present invention provides a new ventilating radiant barrier construction wherein the same can be utilized for reducing the solar or thermal load into a home through a roof while also providing ventilation beneath the exterior of the roof to protect the roof from moisture damage.

The general purpose of the present invention, which will be described subsequently in greater detail, is to provide a new ventilating radiant barrier apparatus and method which has many of the advantages of the insulating and ventilating systems mentioned heretofore and many novel features that result in a new ventilating radiant barrier which is not anticipated, rendered obvious, suggested, or even implied by any of the prior art insulating and ventilating systems, either alone or in any combination thereof.

To attain this, the present invention generally comprises a panel that has a pair of faces, a pair of end edges and a pair of side edges extending between the end edges of the panel. A first of the faces of the panel has a spaced apart pair of perforation rows extending between the end edges of the panel. The second face of the panel has a spaced apart pair of perforation rows extending between the end edges of the panel. The perforation rows of the second face of the panel are positioned between the perforation rows of the first face of the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ventilating radiant barrier apparatus and method which has many of the advantages of the insulating and ventilating systems mentioned heretofore and many novel features that result in a new ventilating radiant barrier which is not anticipated, rendered obvious, suggested, or even implied by any of the prior art insulating and ventilating systems, either alone or in any combination thereof.

It is another object of the present invention to provide a new ventilating radiant barrier which may be easily and efficiently manufactured and marketed.

It is a further object of the present invention to provide a new ventilating radiant barrier which is of a durable and reliable construction.

An even further object of the present invention is to provide a new ventilating radiant barrier which is susceptible to low cost of manufacture with regard to both materials and labor, and which accordingly is then susceptible to low prices of sale to the consuming public, thereby making such ventilating radiant barrier economically available to the buying public.

Still yet another object of the present invention is to provide a new ventilating radiant barrier which provides in the apparatuses and methods of the prior art some of the advantages thereof, while simultaneously overcoming some of the disadvantages normally associated therewith.

Still another object of the present invention is to provide a new ventilating radiant barrier for reducing the solar or thermal load into a home through a roof while also providing ventilation beneath the exterior of the roof to protect the roof from moisture damage.

Yet another object of the present invention is to provide a new ventilating radiant barrier which includes a panel that has a pair of faces, a pair of end edges and a pair of side edges extending between the end edges of the panel. A first of the faces of the panel has a spaced apart pair of perforation rows extending between the end edges of the panel. The second face of the panel has a spaced apart pair of perforation rows extending between the end edges of the panel. The perforation rows of the second face of the panel are positioned between the perforation rows of the first face of the panel.

Still yet another object of the present invention is to provide a new ventilating radiant barrier that has perforated cuts along its sides to space the ventilating radiant barrier from the roof decking to create an air space for ventilating the roof structure without having to use furring strips to create the space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 5 thereof, a new ventilating radiant barrier embodying the principles and concepts of the present invention will be described.

As best illustrated in FIGS. 1 through 5, the ventilating radiant barrier generally comprises a panel that has a pair of faces, a pair of end edges and a pair of side edges extending between the end edges of the panel. A first of the faces of the panel that has a spaced apart pair of perforation rows extending between the end edges of the panel. The second face of the panel that has a spaced apart pair of perforation rows extending between the end edges of the panel. The perforation rows of the second face of the panel are positioned between the perforation rows of the first face of the panel.

Figure 4:
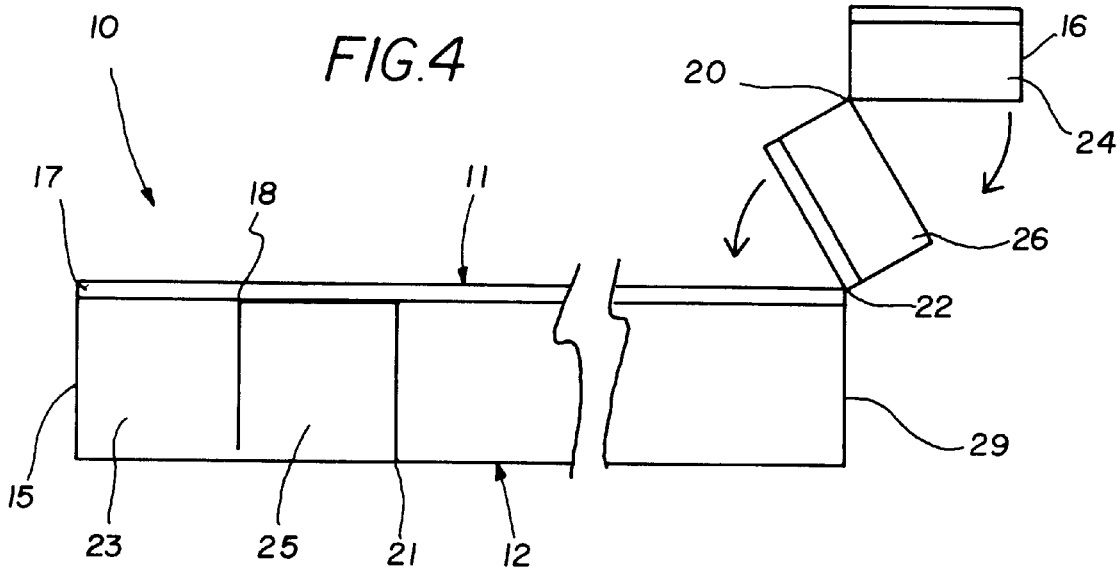
FIG. 4 is a schematic cross sectional view of the present invention.
Figure 5:
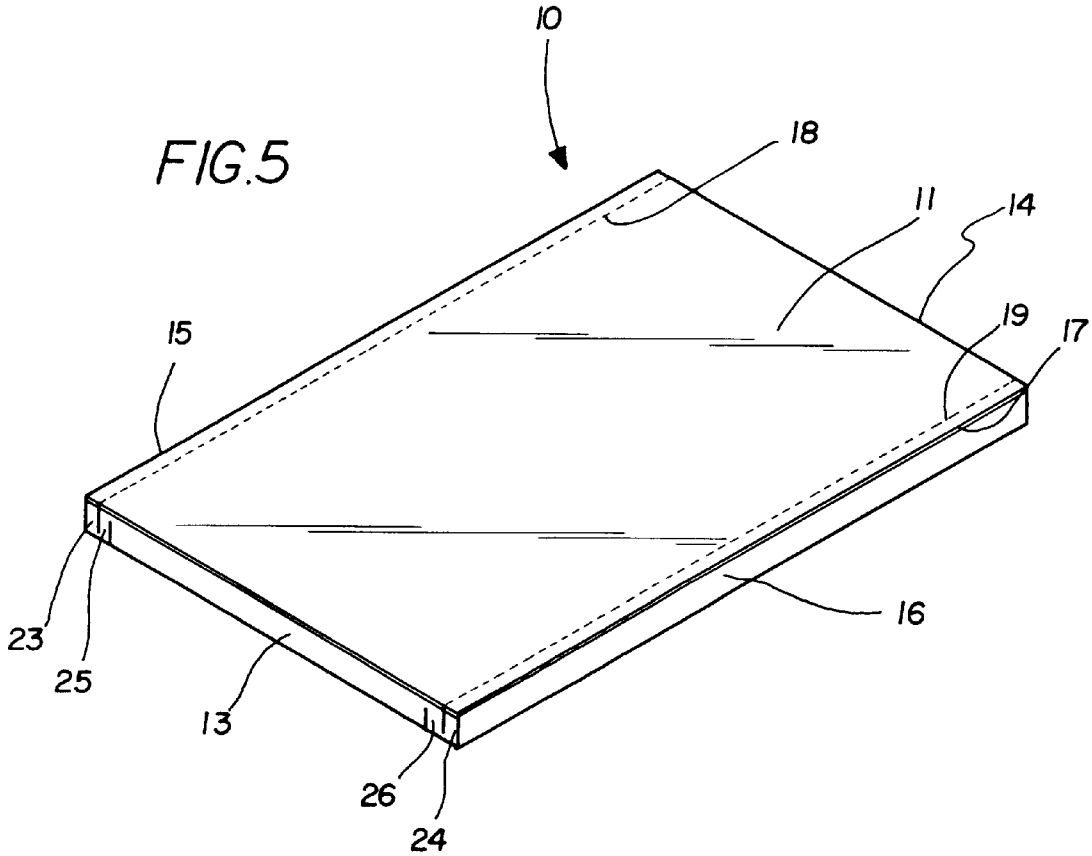
FIG. 5 is a schematic perspective view of the present invention.

In closer detail, the ventilating radiant barrier a generally rectangular panel 10 having a pair of substantially planar and generally rectangular faces 11,12, a pair of generally straight end edges 13,14 and a pair of generally straight side edges 15,16 extending between the end edges of the panel. The end edges of the panel are preferably extended substantially parallel to one another. The side edges of the panel are preferably extended substantially parallel to one another and substantially perpendicular to the end edges of the panel. The panel preferably comprises a foamed insulating material. A first face 11 of the pair of the faces of the panel preferably has a heat reflecting surface substantially covering the first face of the panel. Ideally, as best illustrated in FIG. 4, the heat reflecting surface of the first face of the panel comprises a metallic foil outer layer 17 provided on the first face of the panel. The panel preferably has a thickness defined between the faces of the panel between about ¼ inch and 3 inches. Ideally, the thickness of the panel is about ½ inch.

The first face of the panel that has a spaced apart and substantially parallel pair of perforation rows 18,19 each comprising a plurality of perforation extending between the end edges of the panel. A first perforation row of the first face of the panel is positioned adjacent a first of the side edges of the panel while, similarly, a second perforation row of the first face of the panel is positioned adjacent a second of the side edges of the panel. As best illustrated in FIG. 4, the first face of the panel is cut along each of the perforation rows of the first face of the panel to form a pair of outer fold lines 20 on a second of the faces of the panel extending between the end edges of the panel.

Similarly, the second face of the panel that has a spaced apart and substantially parallel pair of perforations rows 21 each comprising a plurality of perforation extending between the end edges of the panel. The perforation rows of the second face of the panel are positioned between the outer fold lines of the panel. A first perforation row of the second face of the panel is positioned adjacent a first of the outer fold lines of the panel and a second perforation row of the second face of the panel is positioned adjacent a second of the outer fold lines of the panel. Like the first face, the second face of the panel is cut along each of the perforation rows of the second face of the panel to form a pair of inner fold lines 22 on the second face of the panel extending between the end edges of the panel as shown in FIG. 4.

These perforation line defined a plurality of strips on the panel extending between end edges of the panel. This plurality of strips includes a pair of outer strips 23,24 and a pair of inner strips 25,26. A first of the outer strips is defined between the first side edge and the first outer fold line and a second of the outer strips is defined between the second side edge and the second outer fold line. A first of the inner strips is defined between the first outer fold line and the first inner fold line and a second of the inner strips is defined between the second outer fold line and the second inner fold line.

Figure 1:
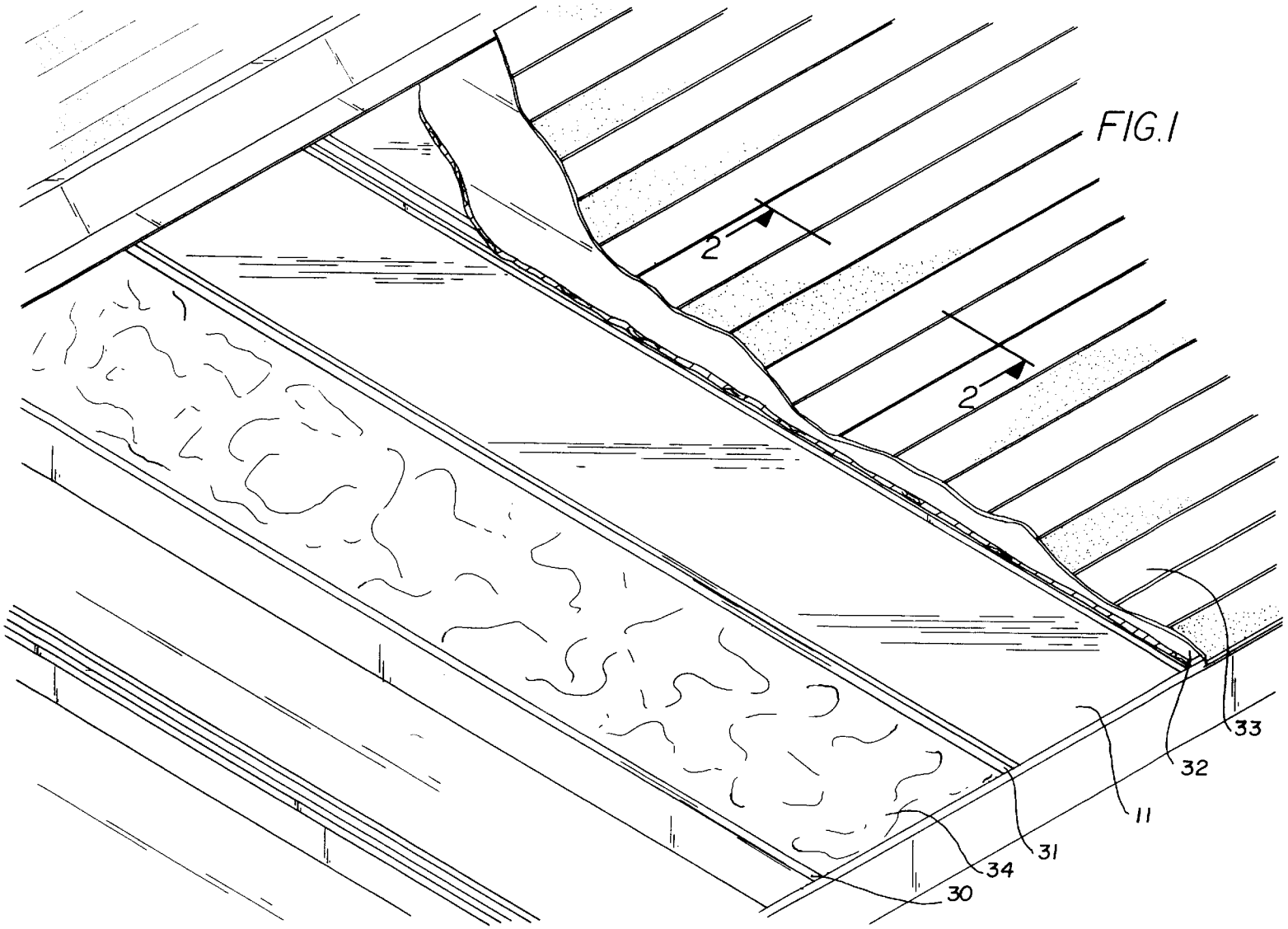
FIG. 1 is a schematic breakaway perspective view of an installed new ventilating radiant barrier according to the present invention.
Figure 2:
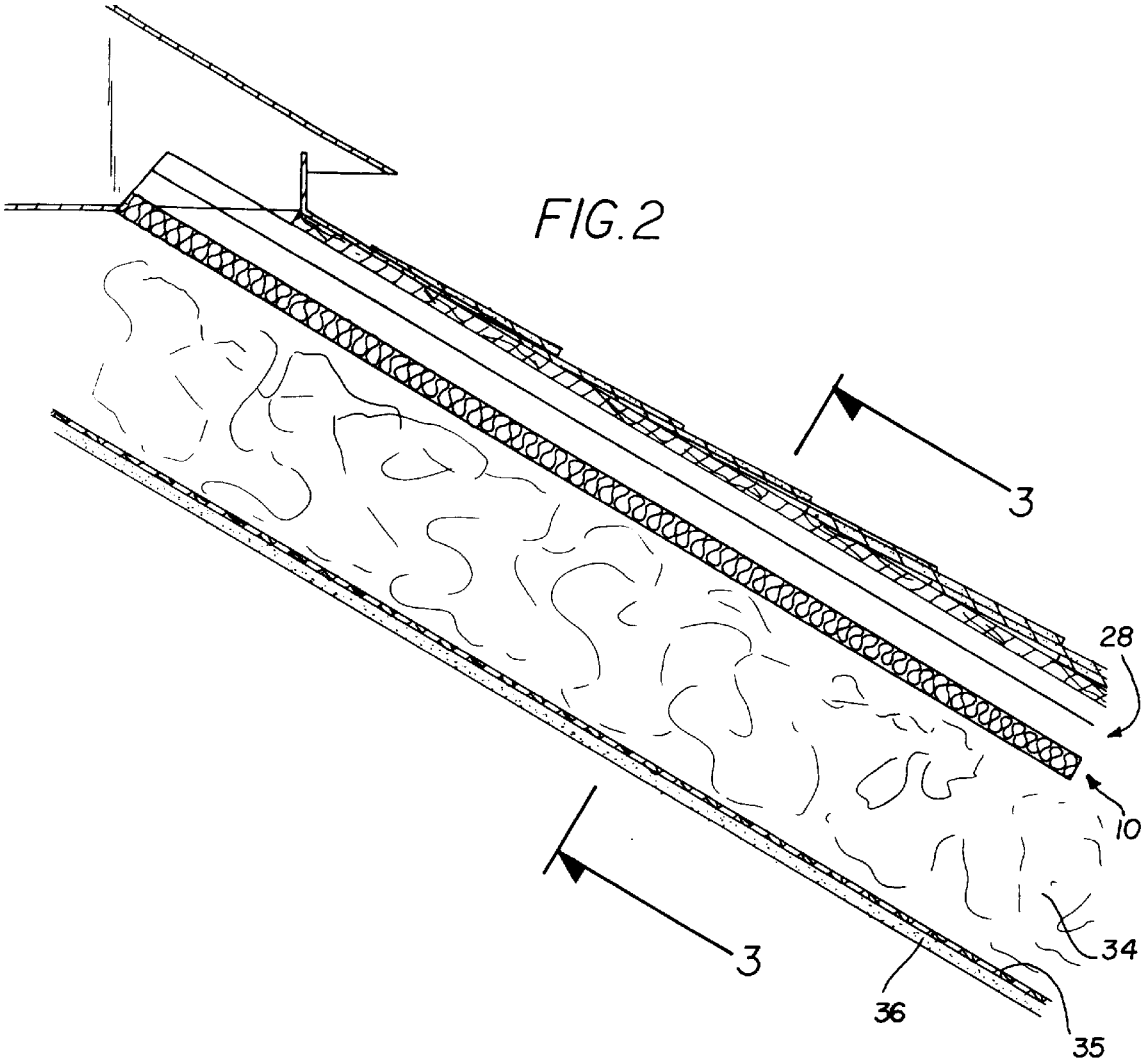
FIG. 2 is a schematic cross sectional view taken from line 2—2 of FIG. 1.
Figure 3:
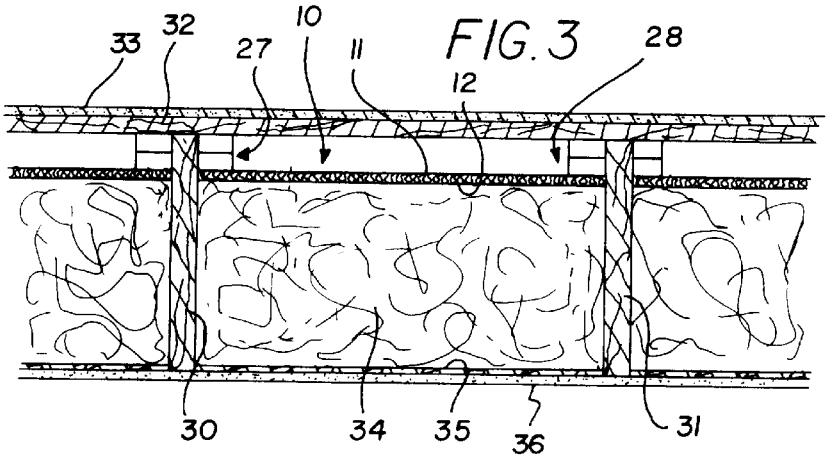
FIG. 3 is a schematic cross sectional view taken from line 3—3 of FIG. 2.

The inner and outer fold lines adjacent each side edge of the panel are folded accordion fashion (FIG. 4) such that each adjacent pair of inner and outer strips are stacked on the first face of the panel to form a pair of stacks 27,28 (FIG. 3)

on the first face of the panel with the inner strips positioned adjacent the first face of the panel in each of the stacks. The panel that has a pair of substantially inner sides 29 extending between the end edges of the panel when the inner and outer strips of the panel are formed in the stacks. Each stack has a thickness about two times the thickness of the panel. Ideally, the thickness of each stack is about 1 inch.

A roof structure comprising a plurality of spaced apart and substantially parallel rafters 30,31, a roof decking 32 coupled to the rafters, a plurality of shingles 33 covering the roof decking. In use, the panel is positioned between an adjacent pair of rafters such that the first face of the panel faces the roof decking. As best illustrated in FIG. 3, the outer strip in each stack of strips abuts an interior surface of the roof decking so that the first face of panel is spaced apart from the roof decking the thickness of the stacks.

Each adjacent pair of rafters has a spacing width defined therebetween. The panel that has an inner width defined between the inner fold lines of the panel. Ideally, the inner width of the panel is slightly less than the spacing width between the adjacent pair of rafters. This way, one of the inner sides of the panel abuts one of the rafters of the adjacent pair of rafters and the other of the inner sides of the panel abuts the other of the rafters of the adjacent pair of rafters such that the panel is frictionally held in position between the adjacent pair of rafters. In typical constructions the spacing width between rafters is either about 16 inches or about 24 and therefore, in an ideal illustrative embodiment, the inner width the panel should be slightly less than about 16 inches or slightly less than about 24 inches accordingly.

A layer of batting-type insulation 34 such as fiberglass batting insulation is positioned between the adjacent pair of rafters. The layer of batting-type insulation abuts the second face of the panel such that the panel is interposed between the roof decking and the layer of batting-type of insulation. A paper insulating backing sheet 35 is coupled to the layer of batting-type of insulation on a surface of the layer of batting-type of insulation opposite the panel such that the layer of batting-type of insulation is interposed between the panel and the backing sheet. A gypsum board 36 may then be coupled to the rafters so that the panel, the layer of batting-type of insulation, and the back sheet are interposed between the roof decking and the gypsum board.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ventilating radiant barrier system, comprising:

a panel having a pair of faces, a pair of end edges and a pair of side edges extending between said end edges of said panel;

a first of said faces of said panel having a spaced apart pair of perforation rows extending between said end edges of said panel;

a first perforation row of said first face of said panel being positioned adjacent a first of said side edges of said panel a second perforation row of said first face of said panel being positioned adjacent a second of said side edges of said panel, said second face of said panel having a spaced apart pair of perforation rows extending between said end edges of said panel;

said perforation rows of said second face of said panel being positioned between said perforation rows of said first face of said panel;

wherein said first face of said panel is cut along each of said perforation rows of said first face of said panel to form a pair of outer fold lines on said second face of said panel extending between said end edges of said panel wherein said second face of said panel is cut along each of said perforation rows of said second face of said panel to form a pair of inner fold lines on said second face of said panel extending between said end edges of said panel wherein said panel that has a pair of outer strips, a first of said outer strips being defined between said first side edge and said first outer fold line, a second of said outer strips being defined between said second side edge and said second outer fold line, said panel having a pair of inner strips, a first of said inner strips being defined between said first outer fold line and a first of said inner fold lines, a second of said inner strips being defined between said second outer fold line and a second of said inner fold lines; and wherein said inner and outer fold lines adjacent each side edge of said panel are folded accordion fashion such that each adjacent pair of inner and outer strips are stacked on said first face of said panel to form a pair of stacks on said first face of said panel, said inner strips being positioned adjacent said first face of said panel in each of said stacks.

2. The ventilating radiant barrier system of claim 1, wherein said panel comprises a foamed material.

3. The ventilating radiant barrier system of claim 1, wherein said first face of said panel that has a heat reflecting surface substantially covering said first face of said panel.

4. The ventilating radiant barrier system of claim 3, wherein said heat reflecting surface of said first face of said panel comprises a metallic foil outer layer provided on said first face of said panel.

5. A roof structure comprising the ventilating radiant barrier system of claim 1, and further comprising a plurality of spaced apart rafters, a roof decking being coupled to said rafters, a plurality of shingles covering said roof decking, said panel being positioned between an adjacent pair of rafters such that said first face of said panel faces said roof decking.

6. The roof structure of claim 5, wherein said outer strip in each stack of strips abuts said roof decking such that said first face of panel is spaced apart from said roof decking.

7. The roof structure of claim 6, wherein said panel that has a pair of substantially inner sides extending between said end edges of said panel when said inner and outer strips of said panel are formed in said stacks, one of said inner sides of said panel abutting one of said rafters of said adjacent pair of rafters and the other of said inner sides of said panel abutting the other of said rafters of said adjacent pair of rafters such that said panel is frictionally held in position between said adjacent pair of rafters.

8. The roof structure of claim 7, further comprising a layer of batting-type insulation being positioned between said adjacent pair of rafters, said layer of batting-type insulation abutting said second face of said panel such that said panel is interposed between said roof decking and said layer of batting-type of insulation.

9. The roof structure of claim 8, comprising:

a generally rectangular panel having a pair of substantially planar and generally rectangular faces, a pair of generally straight end edges and a pair of generally straight side edges extending between said end edges of said panel;

said end edges of said panel being extended substantially parallel to one another, said side edges of said panel being extended substantially parallel to one another and substantially perpendicular to said end edges of said panel;

said panel comprising a foamed material;

a first face of said pair of said faces of said panel having a heat reflecting surface substantially covering said first face of said panel;

said heat reflecting surface of said first face of said panel comprising a metallic foil outer layer provided on said first face of said panel;

said first face of said panel having a spaced apart and substantially parallel pair of perforation rows extending between said end edges of said panel;

a first perforation row of said first face of said panel being positioned adjacent a first of said side edges of said panel, a second perforation row of said first face of said panel being positioned adjacent a second of said side edges of said panel;

said first face of said panel being cut along each of said perforation rows of said first face of said panel to form a pair of outer fold lines on a second of said faces of said panel extending between said end edges of said panel;

said second face of said panel having a spaced apart and substantially parallel pair of perforation rows extending between said end edges of said panel;

said perforation rows of said second face of said panel being positioned between said outer fold lines of said panel;

a first perforation row of said second face of said panel being positioned adjacent a first of said outer fold lines of said panel, a second perforation row of said second face of said panel being positioned adjacent a second of said outer fold lines of said panel;

said second face of said panel being cut along each of said perforation rows of said second face of said panel to form a pair of inner fold lines on said second face of said panel extending between said end edges of said panel;

said panel having a pair of outer strips, a first of said outer strips being defined between said first side edge and said first outer fold line, a second of said outer strips being defined between said second side edge and said second outer fold line;

said panel having a pair of inner strips, a first of said inner strips being defined between said first outer fold line and said first inner fold line, a second of said inner strips being defined between said second outer fold line and said second inner fold line;

said inner and outer fold lines adjacent each side edge of said panel being folded accordion fashion such that each adjacent pair of inner and outer strips are stacked on said first face of said panel to form a pair of stacks on said first face of said panel, said inner strips being positioned adjacent said first face of said panel in each of said stacks;

said panel having a pair of substantially inner sides extending between said end edges of said panel when said inner and outer strips of said panel are formed in said stacks;

a plurality of spaced apart rafters, a roof decking being coupled to said rafters, a plurality of shingles covering said roof decking;

each adjacent pair of rafters having a spacings width defined therebetween, said panel having an inner width defined between said inner fold lines of said panel, wherein said inner width of said panel is slightly less than said spacing width between said adjacent pair of rafters;

said panel being positioned between an adjacent pair of rafters such that said first face of said panel faces said roof decking;

said outer strip in each stack of strips abutting said roof decking such that said first face of panel is spaced apart from said roof decking;

one of said inner sides of said panel abutting one of said rafters of said adjacent pair of rafters and the other of said inner sides of said panel abutting the other of said rafters of said adjacent pair of rafters such that said panel is frictionally held in position between said adjacent pair of rafters;

a layer of batting-type insulation being position between said adjacent pair of rafters, said layer of batting-type insulation abutting said second face of said panel such that said panel is interposed between said roof decking and said layer of hatting-type of insulation; and a backing sheet being coupled to said layer of batting-type of insulation on a surface of said layer of batting-type of insulation opposite said panel such that said layer of batting-type of insulation is interposed between said panel and said backing sheet.

* * * * *